United States Patent [19]

Obama et al.

[11] 4,452,860

[45] Jun. 5, 1984

[54] CARBON FIBERS AND PROCESS FOR PRODUCING THE SAME

[75] Inventors: Isamu Obama; Yoshihisa Yamamoto, both of Okayama, Japan

[73] Assignee: Japan Exlan Co., Ltd., Osaka, Japan

[21] Appl. No.: 460,554

[22] Filed: Jan. 24, 1983

Related U.S. Application Data

[63] Continuation of Ser. No. 199,213, Oct. 21, 1980, abandoned, which is a continuation of Ser. No. 965,244, Nov. 27, 1978, abandoned.

[30] Foreign Application Priority Data

Dec. 21, 1977 [JP] Japan ..... 52-154650

[51] Int. Cl.[3] ..... D01C 5/00; D02G 3/00

[52] U.S. Cl. ..... 428/367; 264/29.2; 264/210.7; 264/210.8; 423/447.1

[58] Field of Search ..... 428/367; 264/182, 210.7, 264/210.8, 29.2; 423/447.1

[56] References Cited

U.S. PATENT DOCUMENTS 3,104,938 9/1963 Kocay et al. ..... 264/210.7 X
3,850,876 11/1974 DiEdwardo et al. ..... 264/182 X
3,917,776 11/1975 Sato et al. ..... 264/182 X

*Primary Examiner*—Lorraine T. Kendell
*Attorney, Agent, or Firm*—Wenderoth, Lind & Ponack

[57] ABSTRACT

In the course of producing acrylic fibers, the spun filament bundle before the heat stretching treatment is subjected to a special stretching treatment in a warm water bath under a specific condition so that the degree of filament separability of said spun filament bundle traveling through the heat stretching step will be maintained within a prescribed range, and when the acrylic fibers so prepared are heat-treated for carbonization, carbon fibers representing a peculiar load-elongation behavior can be produced in an industrially advantageous manner.

2 Claims, 1 Drawing Figure

CARBON FIBERS AND PROCESS FOR PRODUCING THE SAME

This is a continuation of Ser. No. 199,213, filed Oct. 21, 1980, now abandoned which in turn is a continuation of Ser. No. 965,244, filed Nov. 27, 1978, now abandoned.

BACKGROUND OF THE INVENTION

1. Field of the Invention

The present invention relates to carbon fibers (including graphite fibers) having novel physical properties and to a process for producing the same. More specifically, the invention provides a technical information of producing carbon fibers representing a peculiar load-elongation behavior, in an industrially advantageous manner, by a process wherein in the course of producing acrylic fibers, the spun filament bundle before the heat stretching treatment is subjected to a special stretching treatment in a warm water bath under a specific condition so that the degree of filament separability of the spun filament bundle traveling through the heat stretching step will be maintained within a prescribed range, and the acrylic fibers so prepared are heat-treated for carbonization.

2. Description of the Prior Art

It is well known to obtain carbon fibers which are excellent as reinforcing materials, exothermic elements, refractory materials, etc. by heating an acrylonitrile fiber in an oxidizing atmosphere at temperatures between 200° and 400° C. so as to form a cyclized structure in the fiber, followed by heating the cyclized fiber in a non-oxidizing atmosphere at higher temperatures (normally above 800° C.).

However, the so-called thermal stabilization step, which is the step of forming naphthyridine rings in the fiber structure by heating the fiber in an oxidizing atmosphere, is a very important step that influences the physical properties of the carbon fiber which is the final product. It has been believed heretofore that this step requires a heat-treating operation for a long time and this has been the cause of the low productivity of carbon fibers.

If a condition of high-temperature thermal stabilization or a sharp temperature elevation is employed in order to increase the productivity of carbon fibers, abrupt reactions such as intermolecular cross-linking and intramolecular cyclization reactions will occur at a temperature in the vicinity of the exothermic transition point of the fiber. Accompanying such reactions, local accumulation of heat takes place which causes an uneven reaction to produce a pitch-like or tar-like substance. Such a substance causes mutual fusion of filaments (macro-fusion) or exerts a remarkable adverse influence on the physical properties of the carbon fiber, for example a decrease in mechanical strength.

Therefore, various processes have been proposed to accelerate the cyclization reaction so that thermally stabilized fibers can be obtained in a short time. All of these processes, however, have not necessarily contributed to the improvement in economy and industrial productivity of carbon fibers, because such processes are those copolymerizing a special comonomer with the fiber-forming polymer, or employing a treatment with a special chemical, or employing a complicated thermal stabilization step. By these means, the disadvantage of mutual "macro-fusion" of filaments can be eliminated to some extent, but there will still remain the phenomenon of micro-fusion, that is to say a phenomenon of fusion of carbon filaments in a very small number, e.g. from two to several tens of filaments. If carbon filaments with micro-fusion are used for the production of a carbon fiber-resin "composite material" (which is produced from carbon fibers impregnated with a resin, with tension applied to the carbon fibers), a phenomenon which we call "slipping-out" is caused. This remarkably lowers the shaping processability of the material. Thus, it is the present situation that a composite material of high commercial value, i.e. a carbon product of high strength, has not yet been provided.

STATEMENT OF THE INVENTION

In view of such a situation, we have researched intensively to overcome the above-mentioned defects and to provide, in an industrially advantageous manner, carbon fibers which do not cause the micro-fusion phenomenon between filaments. As a result, we directed our attention to the load-elongation curve of carbon fibers and found an interrelation between the micro-fusion behavior and the physical behavior represented by the load-elongation curve. Furthermore, we have found that this relation is closely associated with the properties (for example, tensile strength) of reinforced composite materials. This discovery led us to the present invention.

The principal object of the present invention, therefore, is to provide carbon fibers having novel physical properties.

An object of the invention is to provide carbon fibers which will give a carbon fiber-reinforced composite material having little fluctuation in physical properties and improve the properties of the composite material.

Another object of the invention is to make possible a rapid and uniform thermal stabilization reaction and to obtain carbon fibers which are free from macro- and micro-fusion between filaments, flexible and uniform in quality.

Further objects of the invention will become apparent from the following concrete explanation of the invention made with reference to the annexed drawing, wherein FIG. 1 represents an example of the load-elongation curves of carbon fibers, (A) being the measured curve of a carbon fiber produced according to the present invention, (B) and (C) being those of conventional carbon fibers.

These objects of the present invention are attained by using a carbon fiber such that, on its load-elongation curve, the greatest load peak is situated in the region above 0.7% elongation and no load maximum peak or shoulder-shaped peak resulting from an interaction between the filaments appears in the region below 0.5% elongation.

Such a carbon fiber can be produced by heat-treating (carbonization or graphitization) an acrylic fiber which has been prepared from an acrylonitrile polymer containing at least 90 weight % acrylonitrile and such that the coeficient of filament separability (defined by the formula (2) given below) of the fiber bundle, obtained by spinning said polymer, traveling through the heat-stretching bath, has been caused to be 1.2 to 4.0 by such a procedure that, before the heat stretching treatment, the fiber-bundle is subjected to a stretching treatment satisfying the formula (1) given below, in a warm water bath at a temperature which is by more than 10° C.

lower than the temperature of the heat-stretching treatment and not lower than 30° C.

$$0 < \frac{\log A}{\log A + \log B} < 0.6 \quad (1)$$

wherein A represents the ratio of the stretching carried out before the heat-stretching, and B represents the ratio of the heat-stretching.

$$\text{Coefficient of filament separability} = \frac{\text{Maximum width of the spun fiber-bundle in the heat-stretching step}}{\text{Maximum width of the fiber-bundle after the heat-stretching, in a tensioned, fixed state, in stationary water}}$$

Since the carbon fiber thus obtained is not broken when subjected to a low extension, it does not cause the so-called "slipping-out" upon shaping a composite product and has a very good shaping processability. By the term "slipping-out" is meant that, when an extension force is applied to a carbon fiber-bundle, several single filaments begin to break successively from a very low extension region and finally, at an extension rate lower than the average breaking elongation of the single filaments, the whole fiber-bundle in its entirety breaks as if it slips out.

According to the present invention, the mutual separability between single filaments of an acrylic fiber-bundle in the heat-stretching bath is maintained in a very good state, and therefore the surface and inner substrate of every single filament composing the fiber-bundle undergo a uniform chemical and physical treatment. When such a uniformly treated acrylic fiber is supplied to the subsequent heat treatment step, every single filament composing the fiber-bundle undergoes a uniform cyclizing or cross-linking reaction, and finally there can be obtained a carbon fiber which is free from micro- and macro-fusion and highly uniform in quality.

Since, immediately before the heat-stretching treatment, fiber-bundle is treated in a warm water bath while being stretched, it is crystallized, and by the subsequent heat-stretching treatment, it becomes to have a high degree of orientation. When such a highly oriented acrylic fiber is heat-treated, a high quality carbon fiber of excellent physical properties can be obtained.

In the present invention, since the final fiber-bundle that has passed through the drying heat-treatment causes no fusion or adhesion between single filaments in the heat treatment (firing) step because of its good filament separability, the fiber-bundle can be exposed to rapid temperature elevation, so that the productivity of the carbon fiber is increased.

The carbon fiber according to the present invention is highly uniform in quality for every single filament composing the carbon fiber, so that when the carbon fiber is used as shaping elements for a carbon fiber-reinforced fiber-resin composite material, the adhesion of the carbon fiber to the resin is effected sufficiently, and this makes possible to produce practical, high quality composites. Since any micro-fusion as mentioned above is not observed of course, it is possible to apply a sufficient tension to the carbon fiber upon producing composites (i.e. the carbon fiber has excellent shaping processability of composites) and it is possible to produce composite products of still higher quality. Therefore, the carbon fiber according to the present invention is very important from an industrial viewpoint.

DESCRIPTION OF PREFERRED EMBODIMENTS

Figure 1:
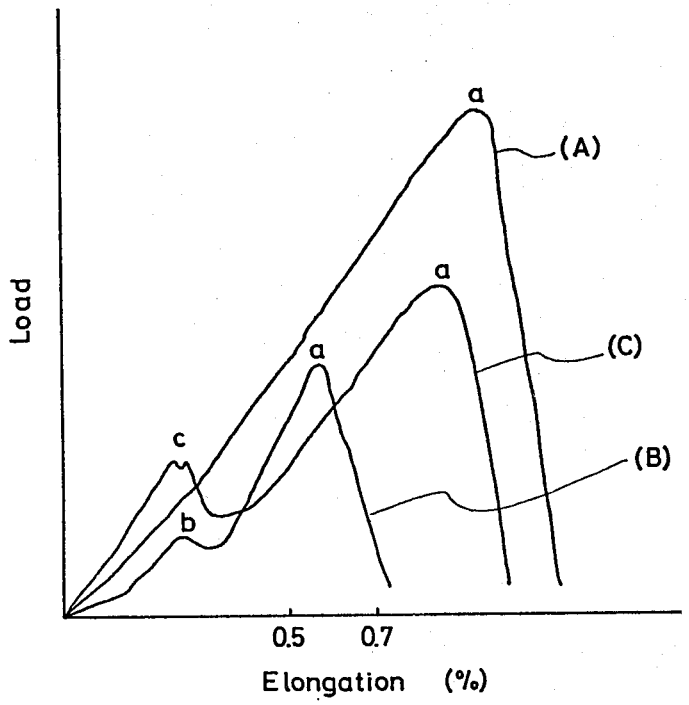

The present invention will be explained in further detail.

As previously mentioned, it is important in the present invention that the interrelation between the micro-fusion and load-elongation curve has been made clear. The breaking elongation of ordinary carbon fibers is from 1.0% to 1.5% for both single filament and fiber-bundle. As regards an ideal carbon fiber, since it is entirely free from micro-fusion and the quality between single filaments is completely uniform, the greatest load peak should be obtained at the position of the breaking elongation as in the case of single filament. In reality, however, the greatest load peak exists in a lower elongation region than the ideal breaking elongation. If the greatest load peak is in a region less than 0.7% elongation, this indicates that there are many relatively small fused portions (belonging to the category of micro-fusion) throughout the whole fiber-bundle and filament breakage is occurring bit by bit from the low elongation region. On the other hand, if a load maximum peak or a shoulder-shaped peak appears in the region less than 0.5% elongation, this indicates that there are relatively large fused portions (also belonging to the category of micro-fusion) of which the fiber-bundle are assembled, and breakage of several to several tens of assembled filaments is occurring. In both cases, when producing composites, since it becomes difficult to apply a proper load, it is necessary to increase the carbon fiber content per volume, and therefore it becomes difficult to produce useful composites which have an excellent tensile strength, etc. Representative examples of the above-mentioned load-elongation curve are shown in FIG. 1 (A)–(C). In FIG. 1, (A) represents the load-elongation curve of a carbon fiber produced according to the present invention, and (B) and (C) respectively represent those of carbon fibers produced by a process deviating from the present invention. Point a shows the greatest load peak, point b a load maximum peak and point c a shoulder-shaped peak, respectively.

We will explain why the load-elongation curve of a carbon fiber having micro-fusion portions draws a curve like the above mentioned curve (B) or (C). It there are micro-fused portions, when a stress acts, the acting force will be distributed unevenly, and a bending deformation or a twisting deformation will be generated at the fused portions. The toughness of the carbon fiber upon the generation of these defomations (especially the twisting deformation) is remarkably low in comparison with the tensile strength in the fiber axis direction because the elongation is relatively small, and therefore the carbon fiber is easily broken (at point b or c) even with a low extension.

An especially important matter in producing the carbon fiber having such peculiar properties as mentioned above is to subject the spun fiber-bundle to a stretching treatment in a warm water bath under prescribed stretching and temperature conditions immediately before the heat-stretching step after the spinning so that the filament separability of the spun fiber-bundle traveling through the heat-stretching bath will be in a favorable state. That is to say, the coefficient of filament separability of the spun fiber-bundle which will be mentioned later is adjusted to between 1.2 and 4.0 by stretching the fiber-bundle immediately before the heat-stretching step in a warm water bath at a temperature by more than 10° C. lower than the heat-stretching bath and not lower than 30° C., so as to satisfy the above-mentioned formula (1). When the coefficient of filament separability of the spun fiber-bundle is less than 1.2, the surfaces of the single filaments composing the spun fiber-bundle and their inner portions cannot undergo uniform chemical and physical treatment. Therefore, the resulting fiber-bundle is not uniform chemically and physically, and in addition, because of the low temperature of the warm water bath treatment before heat-stretching, the crystallization does not proceed sufficiently and the filaments are not highly oriented. Thus, finally, it becomes difficult to produce carbon fibers having excellent physical properties and high quality. On the other hand, when the coefficient of filament separability exceeds 4.0, the filament separation in the heat-stretching bath will proceed to an excessive extent, causing entanglement of the single filaments composing the fiber-bundle. This causes disadvantages such as single filament breakage of the spun fiber-bundle and lowering in operability. Also, the high temperature of the warm water treatment before the heat-stretching brings about excessive crystallization which lowers stretchability, thus lowering the operability.

The above-mentioned coefficient of filament separability of the spun fiber-bundle is defined by measuring by the following method:

An acrylonitrile spinning solution prepared by the usual method is divided into two portions. As for the first portion, after passing through the steps of spinning, cold-stretching, water-washing, gel treatment and heat-stretching, the resulting fiber-bundle is once removed out of the treating system and then is again introduced in a tensioned, fixed state into the heat-stretching bath. As regards the other portion, after being subjected to the steps of spinning, cold-stretching, water-washing and gel treatment under the same conditions as the first one, the resulting fiber-bundle is introduced into the heat-stretching bath and then led to the subsequent steps (for example drying, heat treatment, etc.) to form the final fiber. Now, when the maximum width of each spun fiber-bundle in the heat stretching bath is expressed by l and l′ respectively (l being in a non-tensioned non-fixed state and l′ being in a tensioned, fixed state), then the coefficient of filament separability of the present invention is defined as follows:

Coefficient of filament separability of the spun fiber-bundle $=(l/l')$.

The acrylonitrile polymers used in the present invention are those containing at least 90 weight % acrylonitrile and, as required, copolymerized with other unsaturated monomers. Such unsaturated monomers include well-known ethylenic unsaturated compounds, such as acrylic acid, methacrylic acid, ethacrylic acid, crotonic acid, itaconic acid, maleic acid, mesaconic acid, citraconic acid, and water-soluble salts (alkali metal salts, ammonium salts) thereof; allyl alcohol, methallyl alcohol, oxypropinacrylonitrile, methacrylonitrile, α-methyleneglutaronitrile, isopropenyl acetate, acrylamide, dimethylamincethyl methacrylate, vinylpyridine, vinylpyrrolidone, methyl acrylate, methyl methacrylate, vinyl acetate, allyl chloride, sodium methallylsulfonate, etc. The acrylonitrile polymers are generally produced in a well-known polymerization system such as solvent polymerization system, mass polymerization system, emulsion polymerization system or suspension polymerization system. Upon producing acrylic fibers from such copolymers, an organic solvent such as dimethylfomamide, dimethylacetamide, dimethyl sulfoxide, etc. or an inorganic solvent such as an aqueous solution of zinc chloride, nitric acid, an aqueous solution of a thiocyanate, etc. is used to prepare a spinning solution in the usual way, and the spinning solution is spun and fiberized. Among such spinning means, any of the well-known wet-spinning process, dry-spinning process, dry-wet-spinning process, etc. may be optionally selected. Above all others, by employing the above-mentioned dry-wet-spinning process (which comprises extruding an acrylonitrile spinning solution composed of an acrylonitrile polymer and a solvent therefor, through spinning orifices into air or an inert gas which is a non-coagulating gas for the spinning solution and leading the extruded spinning solution into a coagulating liquid), the objects of the present invention can be advantageously attained.

The fiber-bundle thus spun and fiberized is then subjected to the steps of cold-stretching, water-washing, gel treatment, etc. Thereafter, the fiber-bundle is subjected to the pre-treatment under the specific stretching condition so that the desired coefficient of filament separability can be obtained in the heat-stretching step, and then it is heat-stretched. The fiber-bundle is then subjected, as required, to for example an additional stretching treatment in pressurized steam, drying-compacting treatment, relaxing heat treatment, etc. and is formed into an acrylonitrile fiber as the precursor fiber to be heat-treated for producing carbon fibers. By the above-mentioned gel treatment is meant that water-swollen gel fibers obtained after passing through the steps of spinning, cold-stretching and water-washing, are treated with an aqueous solution of a controlled pH containing alkali metal cations or ammonium ions. By such a treatment, the amount of the alkali metal cations or ammonium ions ionically bonded to the fiber molecules is regualted so that the heat treating time in producing carbon fibers can be shortened or the thermal stabilization reaction can be prevented from its uncontrolled progression.

As previously mentioned, the adjustment of the coefficient of filament separability of the spun fiber-bundle is effected by regulating the temperature and stretchng ratio of the warm water treatment carried out under a specific condition immediately before the heat-stretching treatment. However, the selection of a suitable temperature which will give the desired coefficient of filament separability of from 1.2 to 4.0, depends on the process parameters up to the heat-stretchng step, namely it depends on the combination of the temperature of the spinning solution upon spinning, cold stretchng ratio, temperature of water-washing, pH of the treating liquid upon the gel treatment after the water-washing, pH of the liquid upon the heat stretching, temperature of the stretching bath, stretching ratio, and in the case of employing the dry-wet-spinning process, the interval between the extrusion surface of the spinning orifices and the surface of the coagulating liquid. For example, when the temperature of the spinning solution is low, the temperature of the warm water treatment should be low, and when the cold stretching ratio is high, it is preferable that the temperature of the warm water treatment should be low. Finally, it is necessary to carry out the stretching before the heat-stretching in warm water at a temperature by more than 10° C. lower than the heat-stretching temperature and not lower than 30° C., while employing the stretching ratio in accordance with the above-mentioned formula (1).

While a clear account has not yet been given of the reason why the fiber-bundle traveling through the heat-stretching step can be satisfactorily separated into individual filaments when the fiber-bundle is subjected to a stretching treatment in warm water immediately before the heat-stretching step, it is supposed that this is related the position of the heat-stretching point. That is to say, in the case where the degree of crystallinity of single filaments composing the fiber-bundle is low, the stretching point is on the supply roller of the of the heat-stretching step. When the fiber-bundle leaves the supply roller and comes into the heat-stretching bath, the fibers are already in a stretched state and the thickness does not change. Accordingly, since no force to wring out water from the fibers and the fiber-bundle, that is to say, no force to widen or loosen the fiber-bundle is generated, the fiber-bundle is not loosened or separated into individual filaments in the heat-stretching step. On the other hand, if the fiber-bundle is treated in warm water in a specific stretching condition before the heat stretching step, the crystallinity proceeds and the fibers become difficult to stretch. Accordingly, the stretching point moves from the supply roller, by which the fiber-bundle is sufficiently heated, to a position a little near the stretching roller in the bath, and the fiber-bundle is stretched in a non-fixed state. Therefore, a force to wring out water from the fibers and fiber-bundle, in other words, a force tending to widen the fiber-bundle, acts directly on the fibers and the fiber-bundle is loosened or separated into individual filaments. Furthermore, the fiber-bundle loosened to some degree is increased in buoyancy and becomes to have an angle with respect to the water surface. Therefore, the fiber-bundle travels while beating itself against the water, and this makes the looseness still larger. From such a viewpoint, the regulation of the coefficient of filament separability can be considered possible by placing, in the heat-stretching bath, a fixed bar guide, perpendicular to the fiber-bundle, which can hold up or down the fiber-bundle so that the position of the stretching point can be suitably shifted. Our experiments have proved this means to be effective, but in order to obtain carbon fibers having excellent physical properties and carbon fiber-resin composite materials highly uniform in quality, it is necessary to injure (crack) the precursor fibers as little as possible. Therefore, we are of the opinion that the use of such a bar guide is not desirable.

In producing carbon fibers from the thus-obtained acrylic fiber which is maintained in a very good state in respect to the mutual separability of single filaments, any known conventional heat-treating method may be employed. However, a heat-treating method is generally preferred which comprises a first heating step (the so-called thermal stabilization step) in which the fiber is heated at 150° to 400° C. in an oxidizing atmosphere to form a cyclized structure of naphthyridine rings in the fiber, and a second heating step in which the thermally stabilized fiber is heated at higher temperatures (generally above 800° C.) in a non-oxidizing atmosphere or under reduced pressure to carbonize or graphitize the fiber. Although air is suitable as atmosphere for use in thermal stabilization, it is possible to employ such methods as thermally stabilize the fiber in the presence of sulfur dioxide gas or nitrogen monoxide, or under irradiation of light. As the temperature for carbonization, a temperature generally from 800° to 2000° C. is employed, and to graphitize the thus-obtained carbon fiber, a temperature from 2000° to 3500° C. is generally employed. Also, among the atmospheres for use in carbonization or graphitization, nitrogen, hydrogen, helium, and argon are preferred. To obtain a carbon fiber having a better tensile strength and modulus of elasticity, it is preferable to heat the fiber under tension, as is generally known. It is particularly effective to apply tension upon thermal stabilization and carbonization or graphitization. By employing such a process of the present invention, it is now possible to produce a high-strength and high-elasticity carbon fiber which is free from micro-fusion and is highly uniform in quality, at a high production efficiency and in a short time. Accordingly, the carbon fiber having such excellent properties can be advantageously used as a component for reinforced resin-fiber composite materials to provide excellent properties, and has now come to be used in the wide field of reinforcing materials, exothermic elements, refractory materials, etc.

For a better understanding of the present invention, a representative example of the invention is set forth hereinafter. The percentages and parts in the example are by weight unless otherwise specified.

EXAMPLE 1

A spinning solution (temperature 73° C.) was obtained by dissolving 15.5 parts of an acrylonitrile polymer (obtained by aqueous suspension polymerization using a redox catalyst of $(NH_4)_2S_2O_8/Na_2SO_3$) consisting of 98% acrylonitrile and 2% methacrylic acid in 84.5 parts of a 43.4% aqueous solution of sodium thiocyanate. After this spinning solution was once extruded into air through a spinnerette having 50 spinning orifices, each 0.15 mm in diameter, it was then introduced into a coagulating bath of a 12% aqueous solution of sodium thiocyanate at 5° C. to form coagulated filaments. The interval between the bottom surface of the spinnerette and the liquid surface of the coagulating bath was 0.3 cm. After cold-stretching the thus-obtained spun fiber-bundle 1.3 times, it was washed with water at 30° C. and then introduced into a gel treating bath adjusted to pH 2.2, and then it was stretched at various temperatures as shown in Table 1. The fiber-bundle was then caused to travel through a heat-stretching bath under the stretching condition as shown in Table 1.

The coefficients of filament separability of the spun fiber-bundle in the heat-stretching step were obtained, which were as shown in Table 1. The fiber-bundle which underwent the heat-stretching treatment was then passed through a stretching step in superheated steam and a drying step, and was produced into acrylic fibers having a single-filament fineness of 1.3 deniers.

The acrylic fibers thus obtained were heat-treated respectively to obtain nine kinds of carbon fibers. In this heat treatment, the fiber-bundle was heated in air by an electric furnace from 200° to 300° C. with continuous temperature elevation, spending 20 minutes, to obtain thermally stabilized fibers, which were further heated in a nitrogen gas atmosphere up to 1200° C. with continuous temperature elevation, spending 100 minutes to carbonize the fibers.

The strength, fluctuation rate of strength, and "slipping-out" behavior were observed for the nine kinds of the carbon fibers thus obtained, and the results are shown in Table 1 in comparison with the temperature of the warm water bath treatment, stretching ratio and the coefficient of filament separability in producing the acrylic fibers. As apparent from the comparison in Table 1, by following the present invention, the strength and the fluctuation rate of physical properties are remarkably improved and the "slipping-out" does not occur.

TABLE 1

| Run no. | Stretching ratio (A) before the heat-stretching | Heat stretching ratio (B) | logA / logA + logB | Temp. of warm bath (°C.) | Coefficient of filament separability | Evaluation of carbon fibers: CF* strength (kg/mm²) | Fluctuation rate of strength % | SS* strength (kg/mm²) | Slipping out |
|---|---|---|---|---|---|---|---|---|---|
| 1 | 1 | 3.6 | 0 | 95 | 5 | 221 | 14 | 54 | no |
| 2 | 1 | 3.6 | 0 | 68 | 5 | 283 | 11 | 47 | no |
| 3 | 1 | 3.6 | 0 | 25 | 1 | 280 | 21 | 15 | yes |
| 4 | 1.8 | 2.0 | 0.46 | 68 | 3 | 387 | 7 | 87 | no |
| 5 | 2.15 | 1.67 | 0.60 | 95 | 2 | 316 | 9 | 70 | no |
| 6 | 2.15 | 1.67 | 0.60 | 68 | 4 | 346 | 8 | 79 | no |
| 7 | 2.15 | 1.67 | 0.60 | 25 | 5 | 235 | 14 | 60 | no |
| 8 | 2.5 | 1.44 | 0.72 | 95 | 1 | 278 | 18 | 22 | yes |
| 9 | 2.5 | 1.44 | 0.72 | 68 | 5 | 250 | 15 | 51 | no |
| 10 | 2.5 | 1.44 | 0.72 | 25 | During the stretching before the heat-stretching, the fiber-bundle was broken, and sampling was impossible. | | | | |

*The SS strength is a value calculated from a load-elongation curve obtained by measuring carbon fibers in a non-shaped state. The CF strength is a value calculated from a load-elongation curve obtained by measuring a sample prepared by shaping fibers with a resin (e.g. epoxy resin) so that the volume content is 60%.

Among the above-mentioned carbon fibers, no. 4 and no. 8 were measured for the load-elongation curve. The no. 4 carbon fiber gave a curve like the curve (A) in FIG. 1, while no. 8 gave a curve like the curve (B).

The measurement of load-elongation curves was carried out in accordance with the following procedure:

A non-treated fiber-bundle as-produced was measured with an Instron Model 1115 (Instron Co.; gauge length 200 mm; drawing speed 50 mm/min). A one-directionally fiber-reinforced resin was produced, using the no. 4 and no. 8 carbon fiber, respectively, as the reinforcing material. The resin used was an epoxy thermo-setting resin (Epikote #828, Shell International Chemicals Corp.), and the hardener was BF. MEA. A curing heat-treatment condition of 160° C. (dry heat)×1 hour and a post-curing condition of 180° C. (dry heat)×2 hours were empolyed. In every case, the carbon fiber-reinforced resin was prepared so that the carbon fiber content after curing was 60%.

The two kinds of carbon-fiber reinforced resins were measured for mechanical strength properties in the fiber direction. The results are shown in Table 2.

TABLE 2

| Carbon fiber no. | Carbon fiber-reinforced material: Tesile strength (kg/mm²) | Fluctuation rate of tensile strength (%) |
|---|---|---|
| No. 4 (present invention) | 387 | 6 |
| No. 8 (comparative example) | 278 | 21 |

As apparent from the results shown in Table 2, when we use a carbon fiber having the peculiar physical behavior and produced from an acrylic fiber (precursor) having a good filament separability, the strength properties of composite materials can be remarkably improved. In addition, the fluctuation rate of strength between composite materials is very small, and therefore it is now possible to advantageously produce composite materials having uniform and excellent properties.

What we claim is:

1. A bundle of carbonized filaments, said bundle having a load-elongation curve wherein the greatest load peak is situated in a region above 0.7% elongation and wherein there is no load maximum peak or shoulder-shaped peak resulting from interaction between the filaments appearing in the region below 0.5% elongation, said fiber produced by a process which comprises:

(a) forming a spinning solution of an acrylonitrile polymer containing at least 90 wt % acrylonitrile, (b) extruding said spinning solution through a spinnerette having a plurality of orifices into air or an inert gas which is a non-coagulating gas for said spinning solution to form a filament bundle, (c) cold stretching said filament bundle, (d) water washing said spun filament bundle, (e) introducing said washed filament bundle into a gel treating bath comprising an aqueous solution containing alkali metal or ammonium ions, (f) pre-stretching the filament bundle of step (e) in a water bath at a temperature which is more than 10° C. lower than the heat stretching treatment of following step (g) but not lower than 30° C. and at a stretching ratio satisfying formula (2) below, (g) heat-stretching the filament bundle of step (f) in a water bath having a temperature determined as indicated in step (f) and wherein the coefficient of filament separability of the filament bundle produced by this step is 1.2 to 4.0, said coefficient being determined by the formula (1):

$$\text{Coefficient of filament separability} = \frac{\text{Maximum width of filament bundle during this step}}{\text{Maximum width of filament bundle after this step in a tensioned, fixed state in stationary water}} \quad (1)$$

$$\text{and wherein } 0 < \frac{\log A}{\log A + \log B} \leqq 0.6 \quad (2)$$

wherein A represents the stretching ratio in step (f) and B represents the stretching ratio in step (g) and (h) carbonizing the filament bundle of step (g).

2. A method for producing a bundle of carbonized filaments, said bundle having a load-elongation curve wherein the greatest load peak is situated in a region above 0.7% elongation and wherein there is no load maximum peak or shoulder -shaped peak resulting from interation between the filaments appearing in the region to below 0.5% elongation, said method comprising the following steps:

(a) forming a spinning solution of an acrylonitrile polymer containing at least 90 wt % acrylonitrile,
(b) extruding said spinning solution through a spinnerette having a plurality of orifices into air or an inert gas which is a non-coagulating gas for said spinning solution to form a filament bundle,
(c) cold stretching said filament bundle,
(d) water washiing said spun filament bundle,
(e) introducing said washed filament bundle into a gel treating bath comprising an aqueous solution containing alkali metal or ammonium ions,
(f) pre-stretching the filament bundle of step (e) in a water bath at a temperature which is more than 10° C. lower than the heat stretching treatment of following step (g) but not lower than 30° C. and at a stretching ratio satisfying formula (2) below,
(g) heat-stretching the filament bundle of step (f) in a water bath having a temperature determined as indicated in step (f) and wherein the coefficient of filament separability of the filament bundle produced by this step is 1.2 to 4.0, said coefficient being determined by the formula (1):

$$\text{Coefficient of filament separability} = \frac{\text{Maximum width of filament bundle during this step}}{\text{Maximum width of filament bundle after this step in a tensioned, fixed state in stationary water}} \quad (1)$$

$$\text{and wherein } 0 < \frac{\log A}{\log A + \log B} \leqq 0.6 \quad (2)$$

wherein A represents the stretching ratio in step (f) and B represents the stretching ratio in step (g) and
(h) carbonizing the filament bundle of step (g).

* * * * *